US010550531B2

(12) United States Patent
Van Alfen et al.

(10) Patent No.: US 10,550,531 B2
(45) Date of Patent: Feb. 4, 2020

(54) INTELLIGENT TRAFFIC MANAGEMENT SYSTEM WITH ALL-WEATHER, ILLUMINATED LANE MARKINGS

(71) Applicants: Gregory B. Van Alfen, Lehi, UT (US); Shane McKenna, Salt Lake City, UT (US)

(72) Inventors: Gregory B. Van Alfen, Lehi, UT (US); Shane McKenna, Salt Lake City, UT (US)

(73) Assignee: VICOR SYSTEMS INC. UT (US)

( * ) Notice: Subject to any disclaimer, the term of this patent is extended or adjusted under 35 U.S.C. 154(b) by 354 days.

(21) Appl. No.: 15/603,143

(22) Filed: May 23, 2017

(65) Prior Publication Data

US 2017/0335526 A1 Nov. 23, 2017

Related U.S. Application Data

(60) Provisional application No. 62/340,259, filed on May 23, 2016.

(51) Int. Cl.

| | |
|---|---|
| ***E01F 9/559*** | (2016.01) |
| ***F21V 23/00*** | (2015.01) |
| ***F21W 111/02*** | (2006.01) |
| ***F21Y 115/10*** | (2016.01) |

(52) U.S. Cl.

CPC ..... *E01F 9/559* (2016.02); *F21V 23/003* (2013.01); *F21W 2111/02* (2013.01); *F21Y 2115/10* (2016.08)

(58) Field of Classification Search

None

See application file for complete search history.

(56) References Cited

U.S. PATENT DOCUMENTS

| | | | |
|---|---|---|---|
| 5,917,432 | A | 6/1999 | Rathbone |
| 6,164,782 | A | 12/2000 | Pojar |
| 6,902,305 | B2 | 6/2005 | Wainwright |
| 7,018,131 | B2 | 3/2006 | Jordan |
| 7,273,328 | B2 | 9/2007 | Hunter et al. |
| 7,688,222 | B2 | 3/2010 | Peddie et al. |
| 7,930,095 | B2 | 4/2011 | Lee |

(Continued)

FOREIGN PATENT DOCUMENTS

| | | | |
|---|---|---|---|
| WO | 2011110800 | A1 | 9/2011 |

*Primary Examiner* — Britt D Hanley

(74) *Attorney, Agent, or Firm* — Jason P. Webb; Pearson Butler

(57) ABSTRACT

A road marker apparatus, system and lighting module and corresponding methods of manufacture, installation and replacement. There is a road insert having upwardly facing ridges and an internal cavity with interior surface textures and a tapered front cavity; a boot of incompressible material disposed within the internal cavity of the road insert and form-fit thereto; and a housing body removably disposed within the boot cavity and form-fit thereto. An array of exterior surface textures that operate as a forward operating taper lock between the housing body and the road insert that restricts forward movement and rotation of the housing body with respect to the road insert; and a housing cavity within which one or more physical modules may be disposed. There is a rear lock behind the housing body that prevents rearward displacement of the housing body with respect to the road insert.

6 Claims, 13 Drawing Sheets

(56) References Cited

U.S. PATENT DOCUMENTS

| | | | | |
|---|---|---|---|---|
| 8,328,463 | B2 * | 12/2012 | Dudley | E01F 9/553 362/153.1 |
| 8,425,076 | B2 | 4/2013 | Lockwood et al. | |
| 8,517,626 | B2 * | 8/2013 | Dudley | E01F 9/553 404/12 |
| 8,899,775 | B2 | 12/2014 | Maxik et al. | |
| 8,985,893 | B2 | 3/2015 | Martin et al. | |
| 9,631,780 | B2 * | 4/2017 | Oostdyk | F21V 29/505 |
| 2005/0238425 | A1 | 10/2005 | Safar | |
| 2006/0257205 | A1 | 11/2006 | Jordan et al. | |
| 2010/0098488 | A1 | 4/2010 | Huck et al. | |
| 2011/0035140 | A1 | 2/2011 | Candy | |
| 2017/0096785 | A1 * | 4/2017 | Paulos | E01F 9/571 |
| 2018/0305876 | A1 * | 10/2018 | Langford | G01W 1/02 |
| 2019/0046391 | A1 * | 2/2019 | Henshue | A61H 3/061 |

* cited by examiner

INTELLIGENT TRAFFIC MANAGEMENT SYSTEM WITH ALL-WEATHER, ILLUMINATED LANE MARKINGS

CROSS-REFERENCE TO RELATED APPLICATIONS

This invention claims priority, under 35 U.S.C. § 120, to the U.S. Provisional Patent Application No. 62/340,259 by Van Alfen filed on 23 May 2016, which is incorporated by reference herein in its entirety.

BACKGROUND OF THE INVENTION

Field of the Invention

The present invention relates to traffic management systems, devices, methods and methods of manufacturing the same, specifically to those including illuminated roadway devices.

Description of the Related Art

Drivers on the road, freeways in particular, encounter many dangerous situations. It can be weather (i.e. snow covered roads, rain, fog) related, poor lane markings, road debris, unseen road congestion or accidents, drivers unaware of road repairs or emergency vehicles on the side of the road. Darkness during the night time can make it difficult to see the lanes. Each of these situations can endanger lives on the roadway, especially at freeway speeds.

Other devices are static, one color devices that have the potential to shine in the driver's eyes based on the angle of the LED lights position. They are the equivalent of a lit roadway reflector and are only capable of operating during the night with limited operating hours per charge.

In the related art, it has been known to use [describe field of invention here]. [Describe generally what problems have been faced; setting the stage for the prior art to be introduced]. Some improvements have been made in the field. Examples of references related to the present invention are described below in their own words, and the supporting teachings of each reference are incorporated by reference herein:

U.S. Pat. No. 7,018,131, issued to Jordan, discloses a self-contained solar-powered long-life intelligent illuminated road markers are provided comprising a one-piece housing formed of optionally colored plastic capable of transmitting light. Light is reflected by reflective coating or generated internally by LED which is powered by a long life battery, the charging of which is controlled by electrical circuitry which comprises a peripheral interface controller. The electrical circuitry provides intelligent control for a variety of modes corresponding to diverse driving conditions, and can enter a low-power sleep mode to conserve battery life.

U.S. Pat. No. 8,899,775, issued to Maxik et. al, discloses a lighting device includes a housing attached to a thoroughfare surface. The housing may have a top surface, a proximal face, a distal face, and first and second opposing sidewalls extending between the proximal face and the distal face and extending downwardly from the top surface. The lighting device may further include a first primary optic that may be carried by the housing adjacent the first sidewall that may define a first optical chamber. The lighting device may also further include a first light source that may be positioned within the first optical chamber and may be carried by the housing adjacent the first sidewall. The first sidewall may taper in a direction of the distal face. The first primary optic may be configured to direct light outward and in a direction of the taper in the first sidewall.

U.S. Pat. No. 8,985,893, issued to Martin et al., discloses a road marker and related light based warning device are described. The road marker or device includes a thermal sensor that triggers the illumination of at least one light-emitting diode at a predetermined temperature. The temperature may be associated with ice formation. The light-emitting diode(s) may flash to alert motorists to hazardous road conditions. The road marker or device utilize simple components to increase reliability, particularly when the device is subjected to high heat such as when the device is mounted into hot tar seal. The device further includes a switching element that prevents rapid on/off cycling.

U.S. Pat. No. 5,917,432, issued to Rathbone, discloses a traffic intersection control system or intelligent intersection that analyzes in real time existing traffic flow at intersections to determine whether turn lanes need to be added, lengthened, or done away with, if the lane geometry needs to be modified, and if the time duration of the signals needs to be shortened or lengthened. Conventional, painted, pavement markings are replaced with intelligent pavement markers (IPMs). The IPMs display an intense white or yellow light (e.g., an LED) or can be switched off. Overhead, electronic, lane usage signs alert drivers as to which lanes are through lanes, which lanes are for on-coming traffic, and which lanes are turn lanes. The intersection controller analyzes data about current traffic flow and historical data to determine the most efficient intersection configuration and signal timing for a set time period. If necessary, the controller reconfigures the intersection by controlling the IPMs and overhead lane usage signs using communications equipment.

U.S. Pat. No. 8,425,076, issued to Lockwood et al., discloses a solar-powered airfield light provides high angle light up to about 90°. A solar panel is mounted atop the enclosure but does not overlie a curved transparent shoulder extending upward from the transparent generally cylindrical side walls of the enclosure. An optical element within the enclosure surrounds an LED light source so as to direct light emanating from the LED in two preferential beams, one directed to the shoulder and the other directed to the side walls. A portion of the light impinging on the curved shoulder is redirected to high angles to comply with high angle light requirements for airfield lights.

U.S. Pat. No. 7,930,095, issued to Lee, discloses a method and device for providing traffic information (e.g., congestion & travel-time information, road obstruction information, etc.) for each lane. The method includes encoding traffic information, including creating status information including traffic information on each individual lane belonging to a road link, creating location information about the road link, and creating a traffic information message including the status information and location information. This method includes wirelessly transmitting the message from a server to a terminal.

U.S. Pat. No. 7,688,222, issued to Peddle et al., discloses a traffic informational system provides information to traffic moving along a road and may include a plurality of traffic information devices mountable to the road, each having an integral power producing source, at least a first set of illumination sources, and a wireless communications subsystem. The traffic informational system may further include at least a first external control device comprising at least one antenna and a transmitter communication wirelessly with the traffic information devices and/or with one another. The traffic information device may communicate with one another, and may include sensor for sensing ambient conditions. The system employs various approaches to reducing power consumption and improving communications, and is suitable for a wide range of applications, including use in remote environments.

The inventions heretofore known suffer from a number of disadvantages which include being fragile, not lasting long while installed, failing to illuminate during the daytime, not being remotely controllable, being difficult to install, not being safe, not enhancing safety, not being able to collect data, not enduring common roadway circumstances and environments, rotating out of placement, becoming uninstalled when hit by tires, compressing under operational parameters, and/or not being snow-plowable or being destroyed too often by snow-plows.

What is needed is a traffic management system, device, method and/or method of manufacture that solves one or more of the problems described herein and/or one or more problems that may come to the attention of one skilled in the art upon becoming familiar with this specification.

SUMMARY OF THE INVENTION

The present invention has been developed in response to the present state of the art, and in particular, in response to the problems and needs in the art that have not yet been fully solved by currently available traffic management systems, devices, methods and/or methods of manufacture. Accordingly, the present invention has been developed to provide a traffic management system, device, method and/or method of manufacture.

In one non-limiting embodiment, there is a road marker housing. The road marker housing may include a road insert, a boot, a housing body, and/or a rear lock.

The road insert may include an exterior texture that may include upwardly facing ridges and/or an internal cavity that may include interior surface textures and/or a tapered front cavity. The upwardly facing ridges may be tooth-shaped. The road insert may be rectangular from a top plan view.

The boot may be of incompressible material that may be disposed within the internal cavity of the road insert and/or may form-fit thereto. The boot may have a boot cavity.

The housing body may be removably disposed within the boot cavity and/or may form-fit thereto. The housing body may include one or more of: a tapered front that may be shaped to mate with the tapered front cavity of the road insert and/or thereby be trapped therein; an array of exterior surface textures that may operate together with the interior surface textures of the road insert through the boot to operate as a forward operating taper lock between the housing body and/or the road insert that may restrict forward movement and/or rotation of the housing body with respect to the road insert; and/or a housing cavity within which one or more physical modules may be disposed. The housing body may include a channel that may be disposed along an underside thereof, through which compressed air may be injected to facilitate removal of the housing body from the boot.

The rear lock may be removably disposed inside the road insert behind the housing body and/or may prevent rearward displacement of the housing body with respect to the road insert. It may be that the rear lock is a cam lock. There may also be a wedge lock that may be disposed over the rear lock and that locks the rear lock into place.

In another non-limiting embodiment, there is a method of manufacturing a road marker. The method may include one or more of the steps of: disposing a housing body having a housing cavity into an internal cavity of a road insert and/or into a tapered front cavity of the road insert with a plurality of spacers therebetween the housing body and the road insert; locking a rear lock behind the housing body and to the road insert such that the housing body is prevented from rearward displacement; disposing one or more operational modules within the housing cavity; casting a polymer boot into the space between the housing body and/or the road insert such that the boot is form-fit to each of the housing body and/or the road insert and couples a bottom exterior of the housing body to the internal cavity of the road insert; adhering the plurality of spacers to either the housing body or the road insert; degassing the polymer before the casting step.

It may be that the housing body includes a channel that may be disposed along an underside thereof, through which compressed air may be injected to facilitate removal of the housing body from the boot. The housing body may include exterior textures that cooperate with interior textures of the road insert to form a taper lock therebetween when the boot is cast therebetween.

In still another non-limiting embodiment, there is a method of replacing a housing body of a road marker. The method may include one or more of the steps of: unlocking a rear lock disposed behind the housing body; injecting compressed air into a channel that may be disposed along an underside of the housing body and thereby separating the housing body from a form-fit boot that is form-fit coupled to a road insert; removing the housing body from the boot; placing a second housing body into the boot; and/or locking the rear lock behind the second housing body.

It may be that the road insert has an exterior texture that includes upwardly facing ridges and/or an internal cavity that may include interior surface textures and/or a tapered front cavity and/or the housing body includes a tapered front shaped to mate with the tapered front cavity of the road insert and thereby be trapped therein and an array of exterior surface textures that operate together with the interior surface textures of the road insert through the boot to operate as a forward operating taper lock between the housing body and the road insert that restricts forward movement and rotation of the housing body with respect to the road insert. It may be that the boot consists essentially of a degassed polymer. It may be that the rear lock is a cam lock locked by a wedge lock.

In still yet another non-limiting embodiment, there is a method of installing a road marker into a road having a road surface. The method may include one or more of the steps of: removing a portion of the road, thereby forming a cavity in the road; applying a quantity of epoxy into the cavity; inserting a road marker into the cavity, the road marker including an exterior texture that includes upwardly facing ridges and an internal cavity including interior surface textures and a tapered front cavity into which a boot and housing body are disposed and locked, the housing body including a lighting system to provides illumination through a top surface thereof; leveling the road marker to be flush with the road surface; and curing the epoxy, thereby securing the road marker to the road.

It may be that the step of removing is accomplished by an array of circular saws. It may be that the housing body is selectably removable from the boot.

In still yet a further non-limiting embodiment, there is a system of road markers that may include a plurality of networked road markers that may have sensors disposed within a system of roads, wherein it may be that each road marker is coupled to central control module running as an application on a computing device.

In still yet another further non-limiting embodiment, there is a road marker including a dual beam lighting system including a upwardly directed beam configured to penetrate accumulated snow and/or a diagonally directed beam configured to be visible to drivers during non-snow conditions.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

These features and advantages of the present invention will become more fully apparent from the following description and appended claims, or may be learned by the practice of the invention as set forth hereinafter.

BRIEF DESCRIPTION OF THE DRAWINGS

In order for the advantages of the invention to be readily understood, a more particular description of the invention briefly described above will be rendered by reference to specific embodiments that are illustrated in the appended drawing(s). It is noted that the drawings of the invention are not to scale. The drawings are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which.

DETAILED DESCRIPTION OF THE INVENTION

Figure 1:
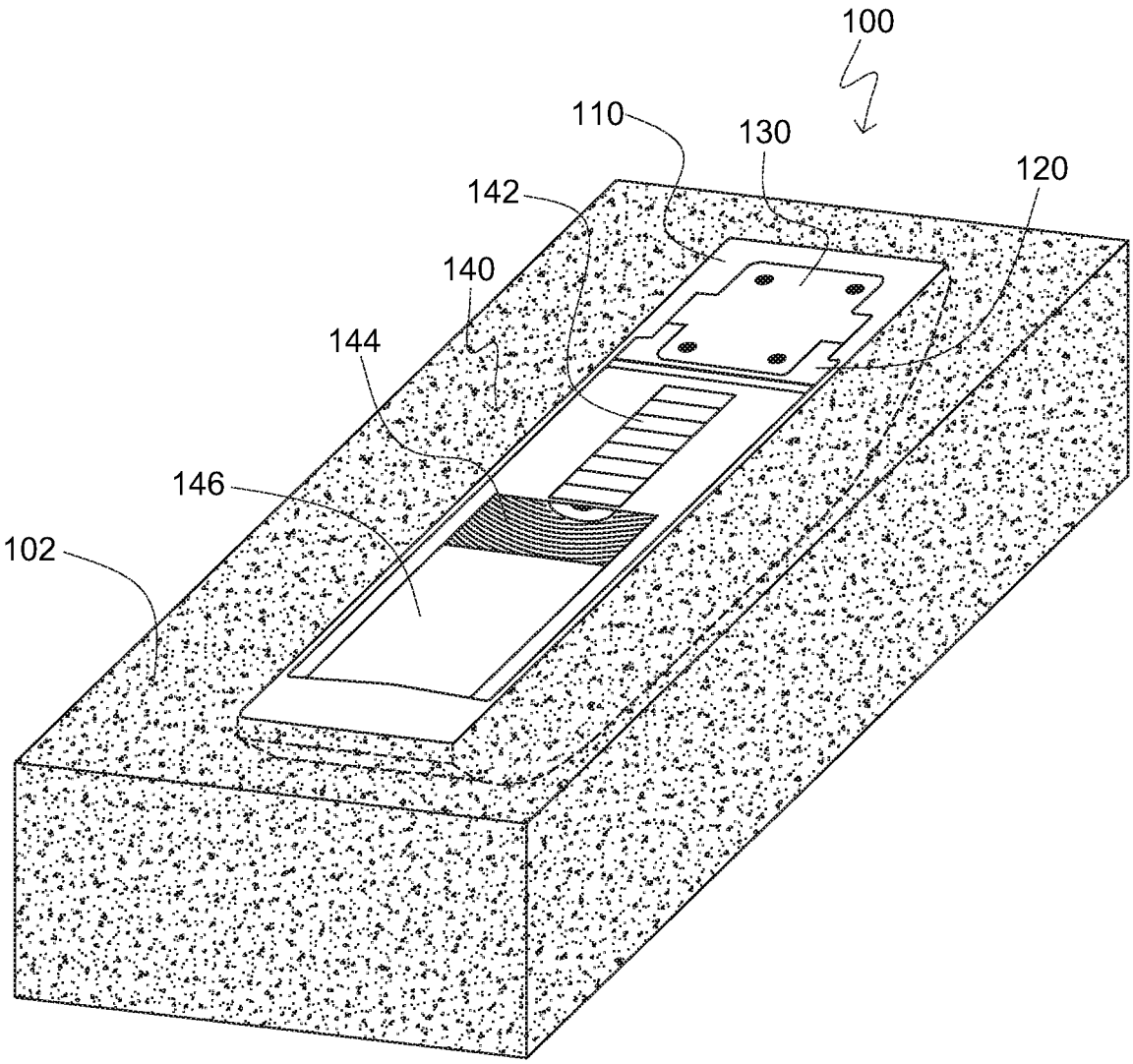
FIG. 1 is a top perspective view of a road marker in situ according to one embodiment of the invention.

For the purposes of promoting an understanding of the principles of the invention, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Many of the functional units described in this specification have been labeled as modules in order to more particularly emphasize their implementation independence. For example, a module may be implemented as a hardware circuit comprising custom VLSI circuits or gate arrays, off-the-shelf semiconductors such as logic chips, transistors, or other discrete components. A module may also be implemented in programmable hardware devices such as field programmable gate arrays, programmable array logic, programmable logic devices or the like. Modules may also be implemented in software for execution by various types of processors. An identified module of programmable or executable code may, for instance, comprise one or more physical or logical blocks of computer instructions which may, for instance, be organized as an object, procedure, or function.

Nevertheless, the executables of an identified module need not be physically located together, but may comprise disparate instructions stored in different locations which, when joined logically together, comprise the module and achieve the stated purpose for the module. Indeed, a module and/or a program of executable code may be a single instruction, or many instructions, and may even be distributed over several different code segments, among different programs, and across several memory devices. Similarly, operational data may be identified and illustrated herein within modules, and may be embodied in any suitable form and organized within any suitable type of data structure. The operational data may be collected as a single data set, or may be distributed over different locations including over different storage devices, and may exist, at least partially, merely as electronic signals on a system or network.

The various system components and/or modules discussed herein may include one or more of the following: a host server, motherboard, network, chipset or other computing system including a processor for processing digital data; a memory device coupled to a processor for storing digital data; an input digitizer coupled to a processor for inputting digital data; an application program stored in a memory device and accessible by a processor for directing processing of digital data by the processor; a display device coupled to a processor and/or a memory device for displaying information derived from digital data processed by the processor; and a plurality of databases including memory device(s) and/or hardware/software driven logical data storage structure(s).

Various databases/memory devices described herein may include records associated with one or more functions, purposes, intended beneficiaries, benefits and the like of one or more modules as described herein or as one of ordinary skill in the art would recognize as appropriate and/or like data useful in the operation of the present invention.

As those skilled in the art will appreciate, any computers discussed herein may include an operating system, such as but not limited to: Andriod, iOS, BSD, IBM z/OS, Windows Phone, Windows CE, Palm OS, Windows Vista, NT, 95/98/2000, OS X, OS2; QNX, UNIX; GNU/Linux; Solaris; MacOS; and etc., as well as various conventional support software and drivers typically associated with computers. The computers may be in a home, industrial or business environment with access to a network. In an exemplary embodiment, access is through the Internet through a commercially-available web-browser software package, including but not limited to Internet Explorer, Google Chrome, Firefox, Opera, and Safari.

The present invention may be described herein in terms of functional block components, functions, options, screen shots, user interactions, optional selections, various processing steps, features, user interfaces, and the like. Each of such described herein may be one or more modules in exemplary embodiments of the invention even if not expressly named herein as being a module. It should be appreciated that such functional blocks and etc. may be realized by any number of hardware and/or software components configured to perform the specified functions. For example, the present invention may employ various integrated circuit components, e.g., memory elements, processing elements, logic elements, scripts, look-up tables, and the like, which may carry out a variety of functions under the control of one or more microprocessors or other control devices. Similarly, the software elements of the present invention may be implemented with any programming or scripting language such as but not limited to Eiffel, Haskell, C, C++, Java, Python, COBOL, Ruby, assembler, Groovy, PERL, Ada, Visual Basic, SQL Stored Procedures, AJAX, Bean Shell, and extensible markup language (XML), with the various algorithms being implemented with any combination of data structures, objects, processes, routines or other programming elements. Further, it should be noted that the present invention may employ any number of conventional techniques for data transmission, signaling, data processing, network control, and the like. Still further, the invention may detect or prevent security issues with a client-side scripting language, such as JavaScript, VBScript or the like.

Additionally, many of the functional units and/or modules herein are described as being "in communication" with other functional units, third party devices/systems and/or modules. Being "in communication" refers to any manner and/or way in which functional units and/or modules, such as, but not limited to, computers, networks, mobile devices, program blocks, chips, scripts, drivers, instruction sets, databases and other types of hardware and/or software, may be in communication with each other. Some non-limiting examples include communicating, sending, and/or receiving data and metadata via: a wired network, a wireless network, shared access databases, circuitry, phone lines, internet backbones, transponders, network cards, busses, satellite signals, electric signals, electrical and magnetic fields and/or pulses, and/or so forth.

As used herein, the term "network" includes any electronic communications means which incorporates both hardware and software components of such. Communication among the parties in accordance with the present invention may be accomplished through any suitable communication channels, such as, for example, a telephone network, an extranet, an intranet, Internet, point of interaction device (point of sale device, personal digital assistant, cellular phone, kiosk, etc.), online communications, off-line communications, wireless communications, transponder communications, local area network (LAN), wide area network (WAN), networked or linked devices and/or the like. Moreover, although the invention may be implemented with TCP/IP communications protocols, the invention may also be implemented using other protocols, including but not limited to IPX, Appletalk, IP-6, NetBIOS, OSI or any number of existing or future protocols. If the network is in the nature of a public network, such as the Internet, it may be advantageous to presume the network to be insecure and open to eavesdroppers. Specific information related to the protocols, standards, and application software utilized in connection with the Internet is generally known to those skilled in the art and, as such, need not be detailed herein. See, for example, DILIP NAIK, INTERNET STANDARDS AND PROTOCOLS (1998); JAVA 2 COMPLETE, various authors, (Sybex 1999); DEBORAH RAY AND ERIC RAY, MASTERING HTML 4.0 (1997); and LOSHIN, TCP/IP CLEARLY EXPLAINED (1997), the contents of which are hereby incorporated by reference.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc.

Each statement of an embodiment, or example, is to be considered independent of any other statement of an embodiment despite any use of similar or identical language characterizing each embodiment. Therefore, where one embodiment is identified as "another embodiment," the identified embodiment is independent of any other embodiments characterized by the language "another embodiment." The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional unrecited elements or method steps. "Comprising" is to be interpreted as including the more restrictive terms "consisting of" and "consisting essentially of."

Figure 2:
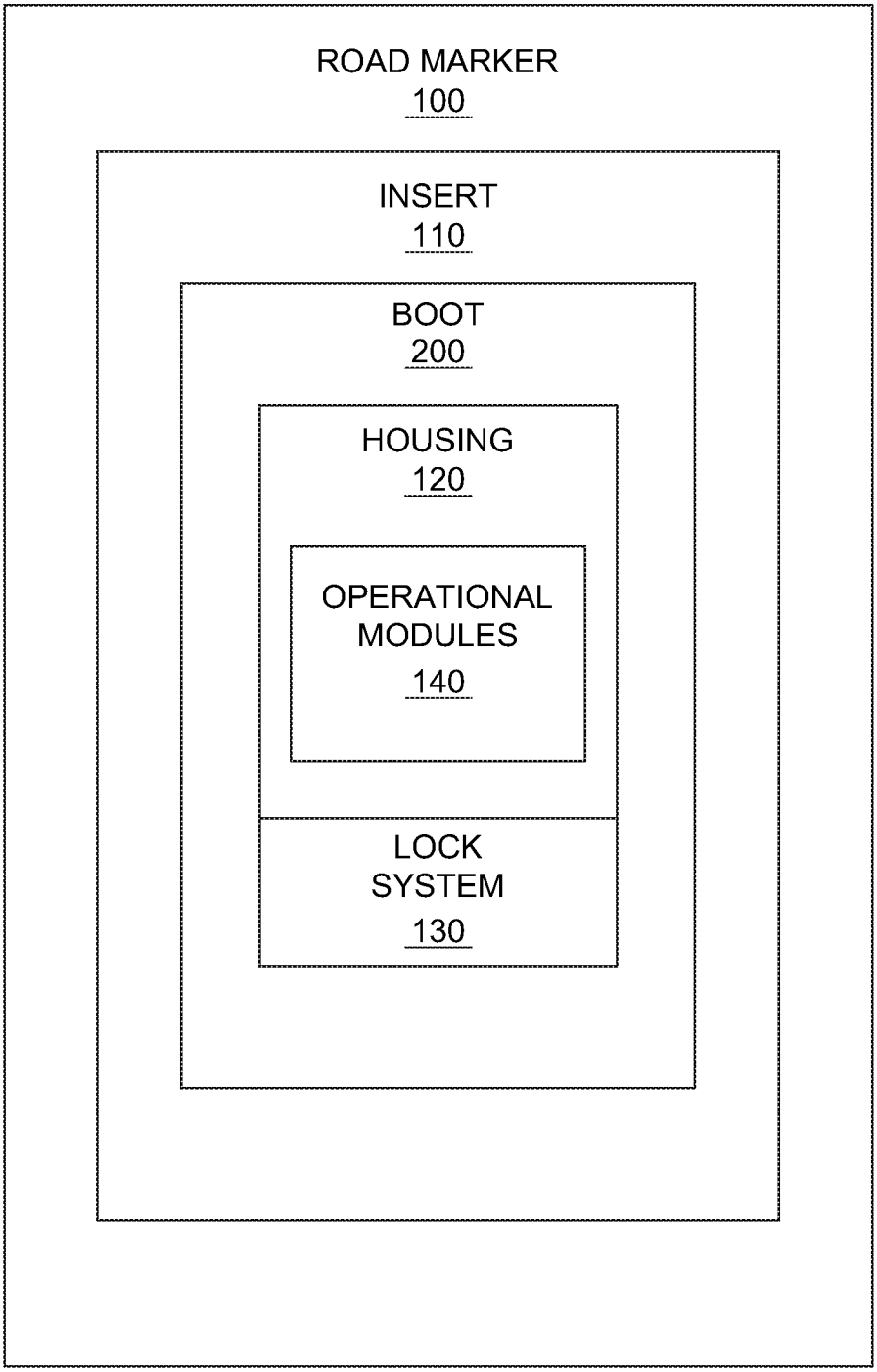
FIG. 2 is a conceptual figure illustrating a road marker according to one embodiment of the invention.
Figure 3:
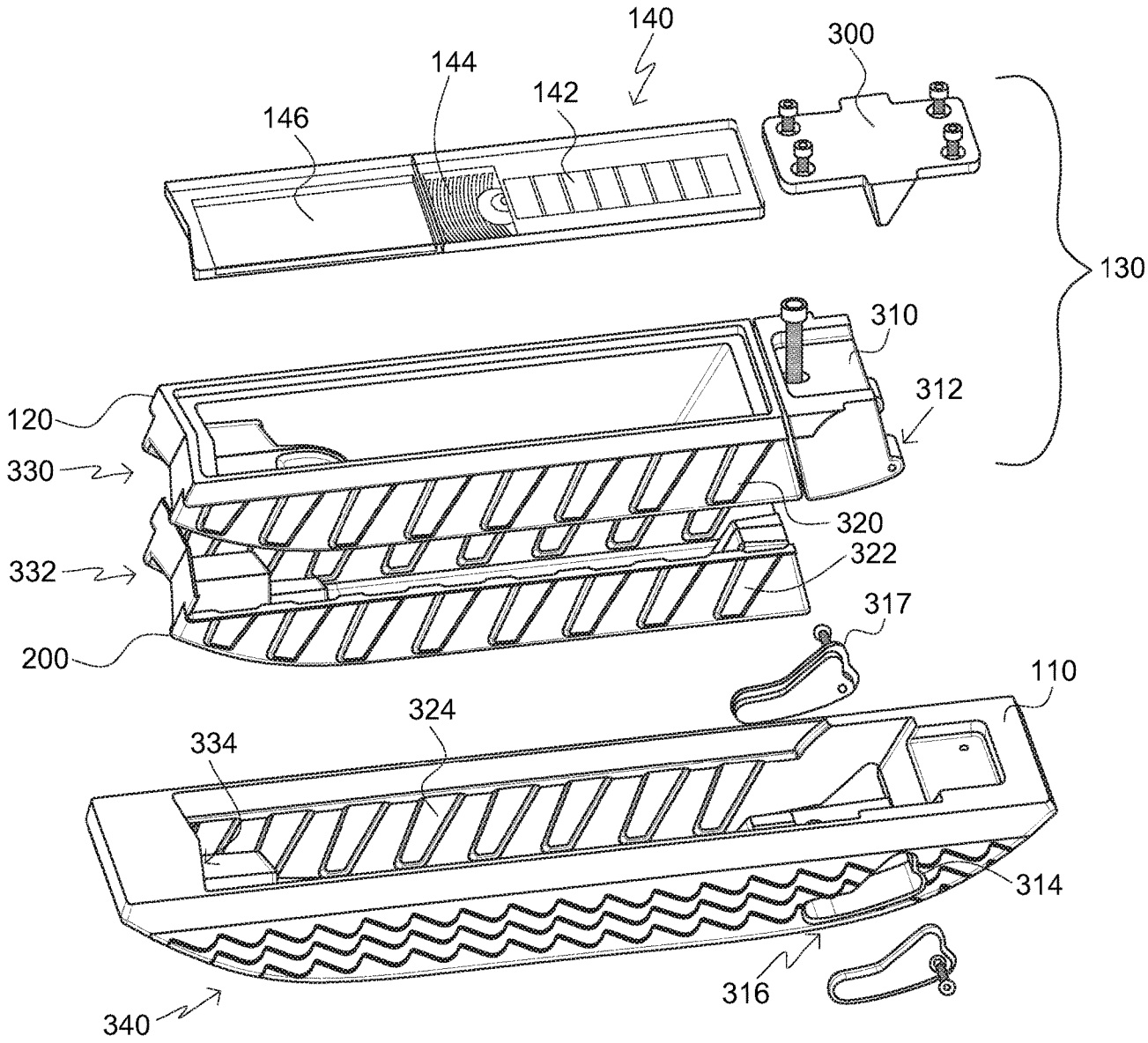
FIG. 3 is an exploded view of a road marker, according to one embodiment of the invention.

Looking specifically at the figures, FIG. 1 is a top perspective view of a road marker in situ according to one embodiment of the invention and FIG. 2 is a conceptual figure illustrating nesting portions of a road marker according to one embodiment of the invention.

There is shown a body of road material 102 (e.g. pavement, asphalt) within which a road marker 100 is disposed. The road material may have been cut, gouged, dug, or otherwise removed to provide space within which the road marker may be disposed or it may have been formed together with the road marker in place. Generally, the material is removed after the road is set and completed so that the road marker can bond firmly to the road and be leveled to the surface of the road without risk of the road changing surface geometries during hardening thereof.

The illustrated road marker 100 is a nested structure, wherein portions thereof are nested within each other and are shaped to thereby fit together. The road marker 100 includes an insert 110 fixed into the road material 102, generally by epoxy. The insert 110 contains and couples to a housing body 120 via a boot 200 which is removably coupled to the housing body 120. The housing body is locked into place by a lock system 130. The housing body contains operational modules 140 which provide the operational functionality thereof as protected by the nested insert, boot, housing body and lock.

The illustrated operation modules 140 include a solar power module 142 functionally coupled to each of an upwardly directed light module 144 and a diagonally directed light module 146. There may also be additional modules disposed therein such as but not limited to communication modules (e.g. wireless adapters, transmitters, transceivers, network cards, and the like which may operate via transmission forms associated with radio, wifi, telephone, near-field communications, and the like), sensors (e.g. GPS devices, temperature sensors, stress/strain/force/weight sensors, vibration sensors, light sensors, audio sensors), timers/clocks, power level sensors, current/voltage sensors, motion sensors (e.g. accelerometers), and the like and combinations thereof which may be controlled by one or more processors having access to one or more busses, memory devices, actuators/buttons, power supplies, and the like and combinations thereof.

In operation, the road marker 100 is fixed in place embedded within a road, generally of asphalt, concrete, pavement, and/or combinations thereof. The road marker draws power through the power module 142 which may be stored in an internal battery that may be disposed within and protected by the housing body. The lighting system 144, 146 uses that power to display lights at various times and in various manners and may be controlled by a control module disposed within the housing body 120 in functional communication thereto (e.g. on a timer, according to a stored/predetermined sequence, according to remote controls). There may be a communication module disposed within the housing in communication with a control module that permits remote operation/control of the road marker 100. Accordingly, the road marker allows for lighting to appear from the road surface to perform various beneficial operations, such as but not limited to directing/manipulating traffic patterns, marking a road (especially during harsh weather and/or snow build-up), hazard notification, and otherwise providing warnings/instructions to drivers.

The illustrated road marker 100 includes a housing body that is coupled to the insert via boot, wherein the housing body is removable from the boot, which allows for much easier, quicker and thereby, less expensive repairs and upgrades, since the insert does not have to be removed from the road. Further, the boot on combination with the associated locks, as described hereafter, provides a secure and firm coupling between the housing body and the insert, which restricts lateral and rotational movement of the housing body with respect to the insert to virtually nothing, thereby keeping the housing body secured thereto and level with the road, even under the stress of multi-ton vehicles. This structure provides for a robust and durable in-road lighting solution, which protectively houses operational components 140 therewithin and allows for replacement of the housing and any and all of the components stored thereby without having to remove the insert from the road. Advantageously, this permits reduced installation and operational costs, including but not limited to ongoing maintenance costs.

In one non-limiting embodiment, there is an in-roadway traffic management device. It has several separate functions: 1) night-time where it is an illumination in the road that lets people know where their lanes are: 2) daytime/nighttime where it is a traffic management tool that illuminates when there is a hazard ahead or a need to give instructions to drivers. Such may be part of a larger "smart-road" technology system. Physically, it is a hardware-software system that includes in-road devices that are installed flush to the roadway with epoxy utilizing a unique housing structure. The device includes a dual-light system including a light directed upwardly that is very bright and able to show through many inches of snow.

Such a road marker may include one or more of the following: an insert, which may be of aluminum that is molded in a gravity fill process so that it is much stronger than typical cast aluminum; a boot that may be cast/molded to the interior of the insert; a housing body that may be locked into place via one or more locks and which may contain modules/electronics. The modules/electronics may include one or more of: a lighting system with multiple lights and multiple colors of lights wherein there may be one or more tight focus LEDs and/or broad focus LEDs in the same system, a power system that may include one or more solar cells and/or rechargeable batteries, a network/communication module, a control module, and/or one or more sensors (e.g. temperature, vibration, light), and/or a data storage system.

The road marker may be treated with one or more hydrophobic and/or oleophobic treatments to prevent water/etc. from accumulating and/or penetrating within the device, such as but not limited to Manganese oxide polystyrene (MnO2/PS) nano-composite, Zinc oxide polystyrene (ZnO/PS) nano-composite, Precipitated calcium carbonate, Carbon nano-tube structures, and/or Silica nano-coatings.

Figure 4:
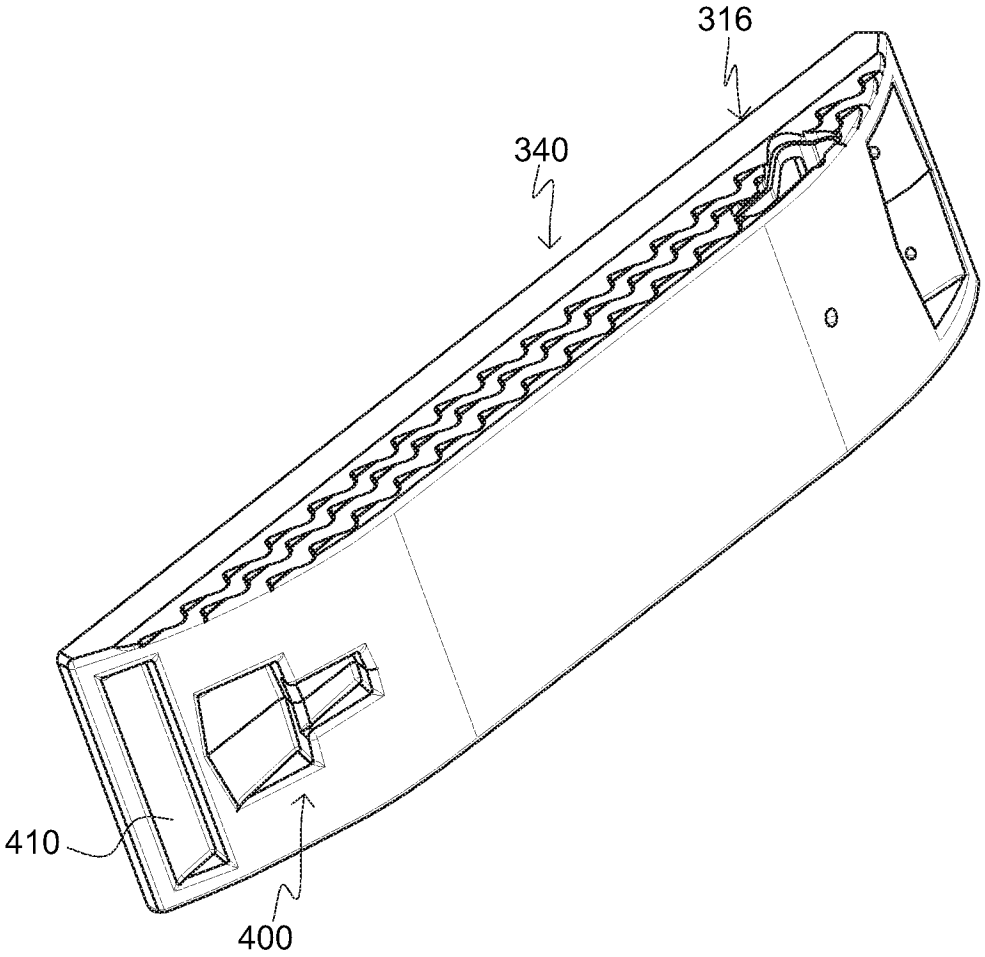
FIG. 4 is a bottom perspective view of an insert, according to one embodiment of the invention.
Figure 5:
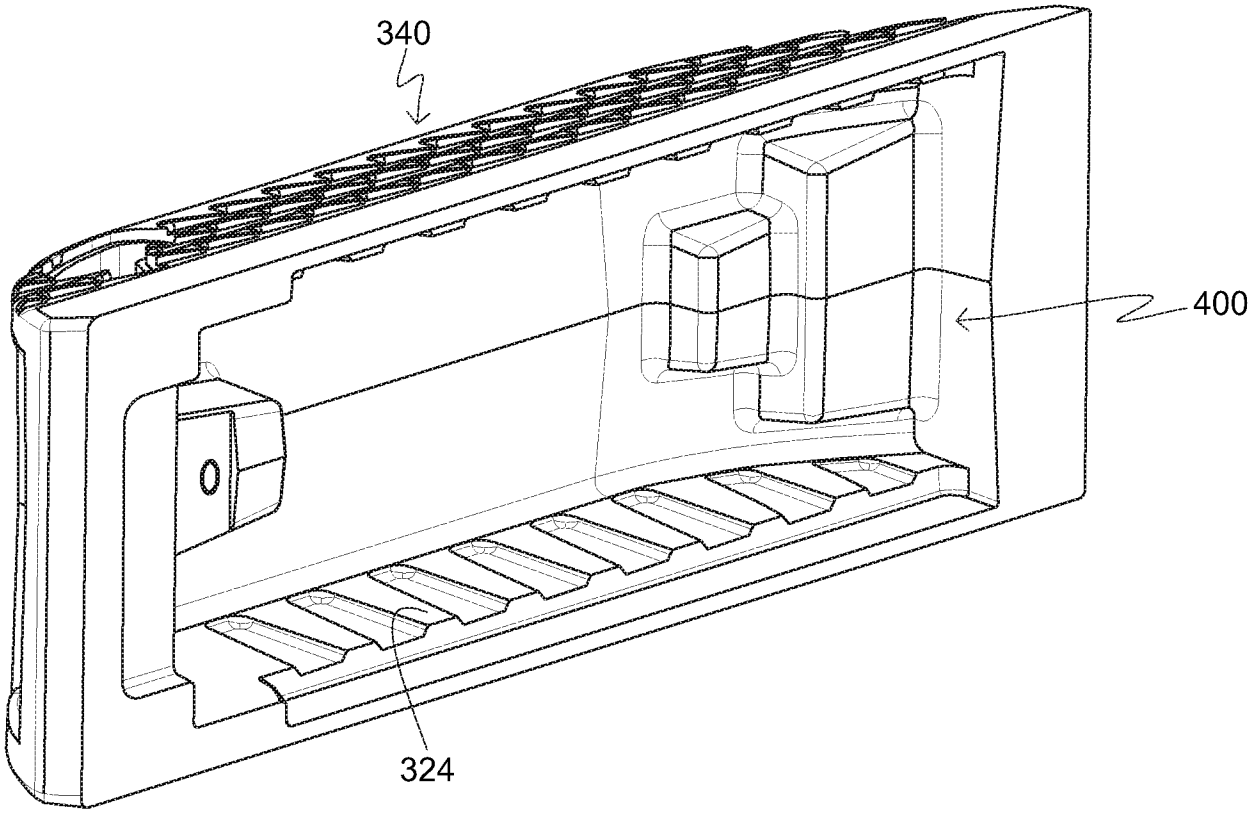
FIG. 5 is a top perspective view of an insert, according to one embodiment of the invention.
Figure 6:
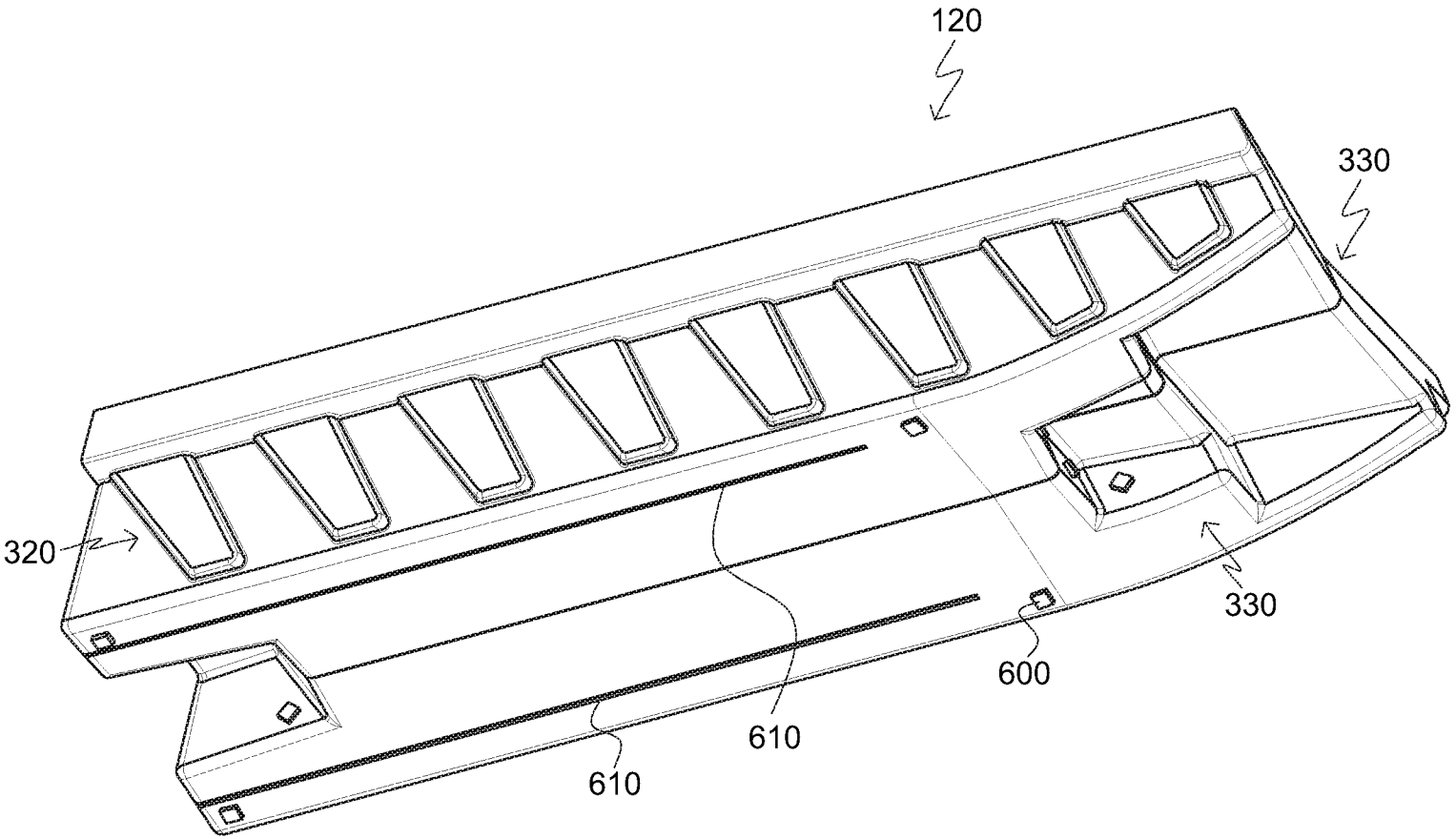
FIG. 6 is a bottom perspective view of a housing, according to one embodiment of the invention.
Figure 7:
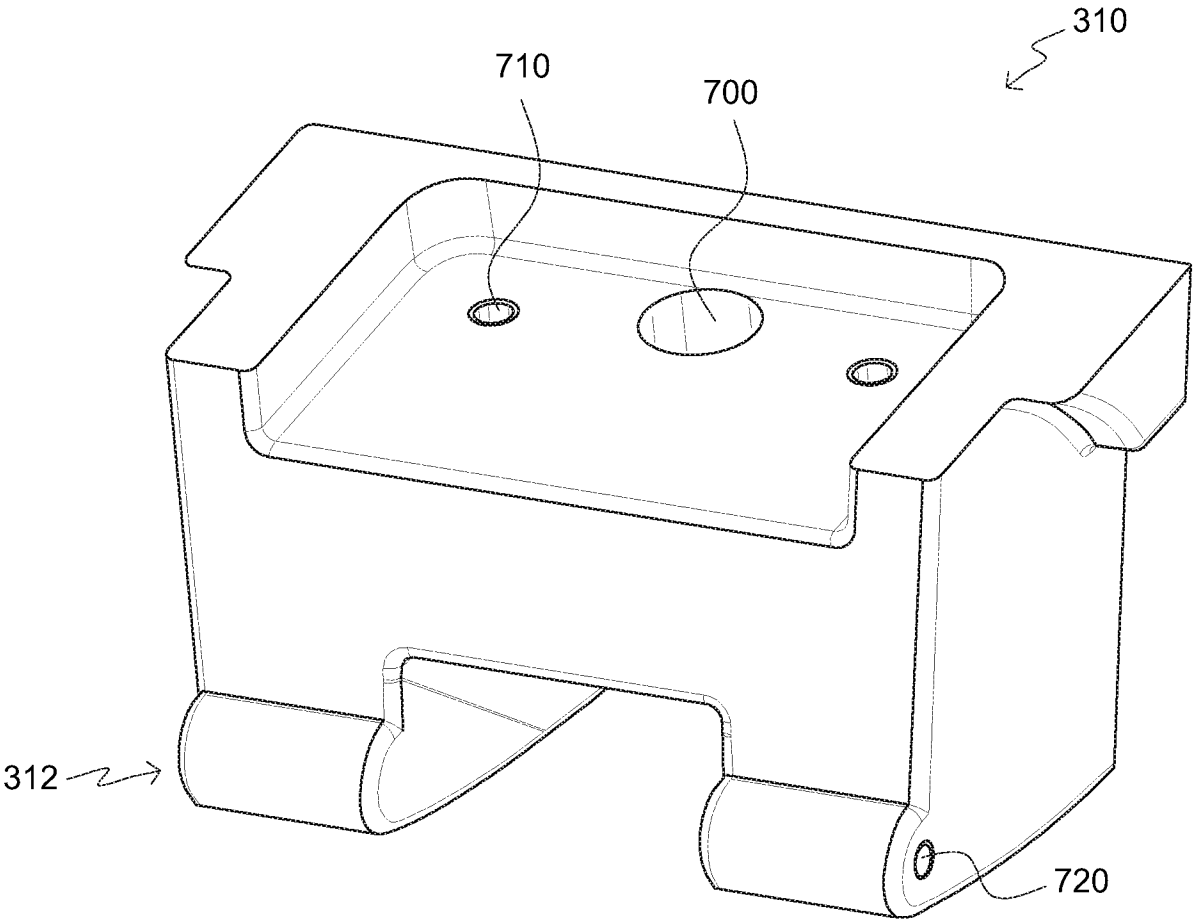
FIG. 7 is a top perspective view of a rear lock, according to one embodiment of the invention.
Figure 8:
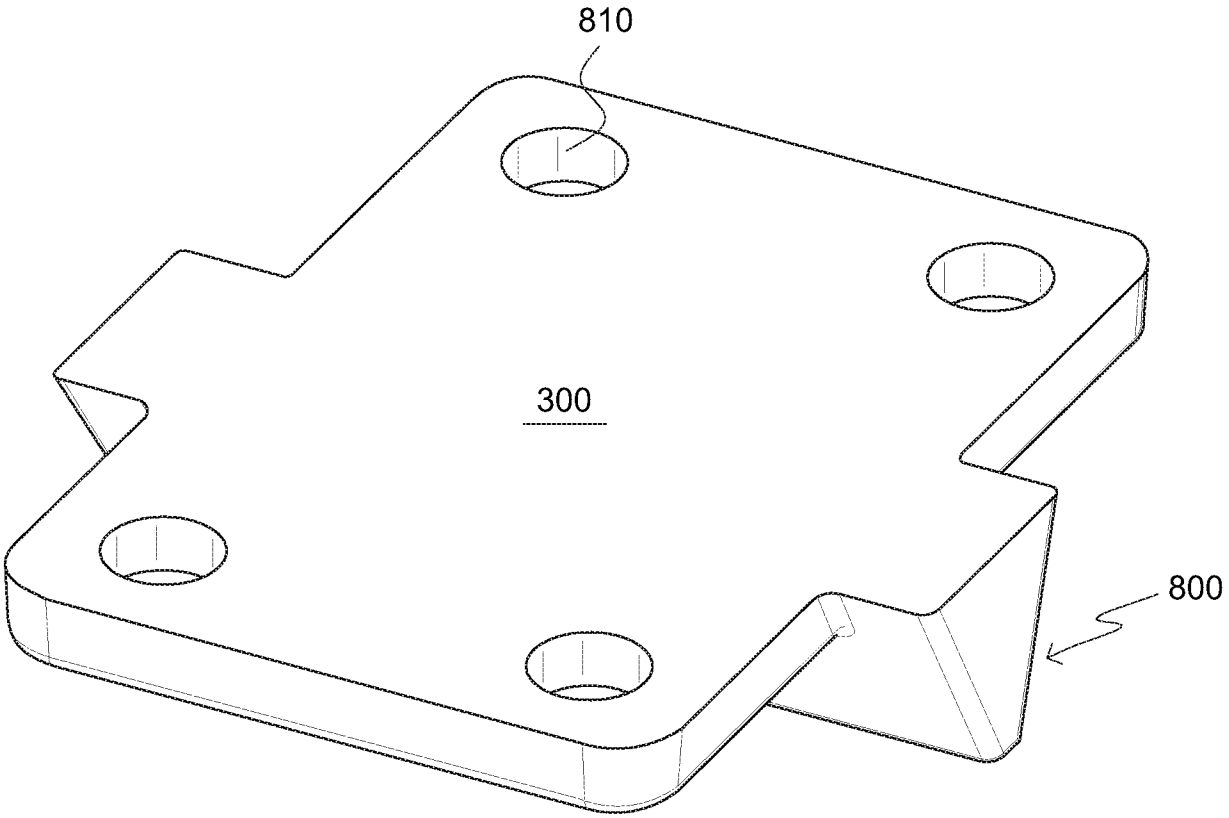
FIG. 8 is a top perspective view of a wedge lock, according to one embodiment of the invention.

Turning to FIGS. 3-8 there is shown an exploded view (FIG. 3) of a road marker, according to one embodiment of the invention along with various views of parts thereof (FIGS. 4 and 5: bottom and top perspective views of an insert; FIG. 6: bottom perspective view of a housing; FIG. 7: top perspective view of a rear lock; and FIG. 8: top perspective view of a wedge lock). There is shown an insert 110 into which is nested a boot 200; a housing body 120; locks 130; and operational modules 140.

The illustrated road insert 110 has an exterior texture that includes upwardly facing ridges 340 and an internal cavity including interior surface textures 324 and a tapered front cavity 400, including a wide scoop portion 410 that is front-most thereof. The illustrated upwardly facing ridges 340 are tooth-shaped. The road insert 110 is rectangular from a top plan view. There are a pair of apertures 316 through a bottom rear of the insert adjacent to the cam receiver 314, which allow for the cam receiver to be machined. Covers 317 may be screwed into place to cover such apertures 316 during assembly.

The illustrated boot 200 is of an incompressible material, generally of a degassed polymer or other material which may be cast (e.g. injection molding) which does not change volume under pressure. The boot is disposed within the internal cavity of the road insert and form-fit thereto. The boot has a boot cavity into which the housing body is disposed when assembled. The boot also includes interior and exterior surface textures 322 that are oriented in a forward-downward diagonal orientation and that mate with the similarly shaped surface textures 324, 320 of the interior of the insert 110 and the exterior of the housing body 120 respectively. This forward-downward diagonal orientation of the surface textures 320, 322, 324 facilitate in locking the nested portions together and preventing rotational and forward movement of the housing body and/or boot with respect to the insert because any such forward movement will drive the portions closer to each other. Since they are already form-fit to each other, then they cannot move substantially closer together under operating conditions and therefore forward movement is restricted. Similarly, rotational movement that lowers the back of the housing body and/or raises the front with respect to the insert is similarly restricted.

Similarly, the illustrated boot 200 also includes a boot taper lock 332 which receives a tapered front 330 of the housing body 120 and mates into a insert taper lock 334, 400, 410. Together with the rear lock(s), which prevent rear-ward movement and rotational movement, the front taper locks and the surface textures prevent motion of the housing body with respect to both the boot and the insert. Since the boot is incompressible under operating conditions, this secures the housing body firmly in place during operations, even when subject to being driven over by vehicles.

The illustrated a housing body 120 is removably disposed within the boot cavity and form-fit thereto. The housing body includes: a tapered front 330 shaped to mate with an interior front cavity 334 that corresponds to the tapered front cavity 400 of the road insert 110 and thereby be trapped therein via a tapered front 332 of the boot; an array of exterior surface textures 320 that operate together with the interior surface textures 324 of the road insert 120 through matching textures 322 of the boot 200 to operate as a forward operating taper lock between the housing body 120 and the road insert 110 that restricts forward movement and rotation of the housing body 120 with respect to the road insert 110; and a housing cavity within which one or more physical modules 140 may be disposed.

The housing body includes a pair of channels 610 disposed along a backside and underside thereof, through which compressed air may be injected to facilitate removal of the housing body from the boot 200. During assembly and casting of the boot, there may be small strips of tape or other barriers disposed over the channels so that the boot 200 does not fully extend into the channels 610. The housing body 120 includes a plurality of spacers 600 coupled thereto which operate to space the housing body 120 apart from the insert 110 during final assembly and casting of the boot 200, such that there is space between the housing body 120 and insert 110 where the boot 200 is formed.

The illustrated lock 130 includes a rear cam lock 310 and a wedge lock 300. These two locks operate together to firmly secure the rear of the housing body and boot such that neither may shift or rotate rearwardly. The two locks support each other and, being of different types, provide overlapping protection while not being subject to identical vulnerabilities. This results in highly secure couplings and prevents undesired movement which could place the housing body and/or its contents in danger of being damaged. It may be that there are two locks which are not cam locks and/or wedge locks, but locks of one or more other types which operate in concert to protect the housing body and/or boot.

The illustrated rear lock 310 is removably disposed inside the road insert 110 behind the housing body 120 and it prevents rearward displacement of the housing body 120 with respect to the road insert 110. The illustrated rear lock 310 is a cam lock, insomuch as it rotates into place about a cam 312 disposed at a bottom thereof that fits into a cam receptor 314 disposed within a rear interior of the insert 110. The illustrated cam 312 includes threaded holes 720 through which screws from the insert may couple. There are threaded holes 710 into which screws from the wedge lock 300 may couple. There is an aperture 700 through which a screw may extend to couple the rear lock into place and prevent rotation of the cam 312.

The illustrated wedge lock 300 is disposed over the rear lock 310 and locks the rear lock 310 into place. The wedge lock includes a wedge 800 which fits behind the camp lock and prevents it from rotating backwards and which also applies leverage, as a wedge, to the backside of the cam lock while the wedge lock is being secured in place, thereby enhancing the strength of such protection without requiring great force to be applied by an installer.

The wedge lock 300 may include one or more bias members (e.g. a foam pad) disposed on an underside thereof that may be positioned to sit over and friction-fit to a top of a screw disposed through the central aperture 700 of the cam lock 310 such that the screw thereof is restricted from turning while the wedge lock 300 is in place. Apertures 810 through the corners of the wedge lock 300 allow for screws to be disposed therethrough to couple the wedge lock to the cam lock (rear lock) 310 and the top rear of the insert 110.

The illustrated operation modules 140 include a solar power module 142 functionally coupled to each of an upwardly directed light module 144 and a diagonally directed light module 146. It is understood that various other lighting systems may be utilized and/or other modules, such as but not limited to communication modules, sensors, and the like and that such may be controlled via one or more computer devices which may be disposed within the housing body and/or remote thereto.

Figure 9:
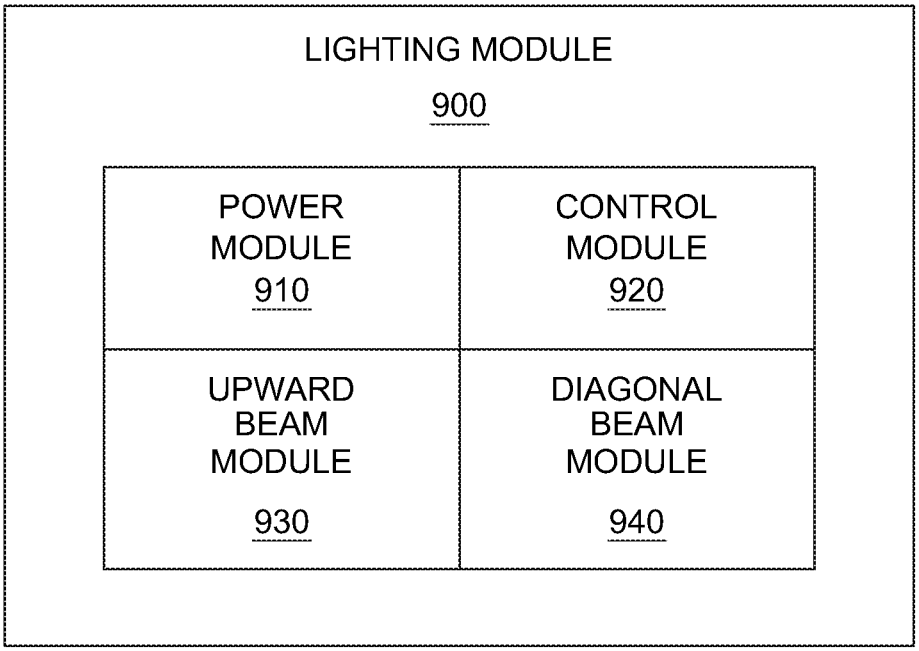
FIG. 9 is module diagram of a lighting module, according to one embodiment of the invention.
Figure 10:
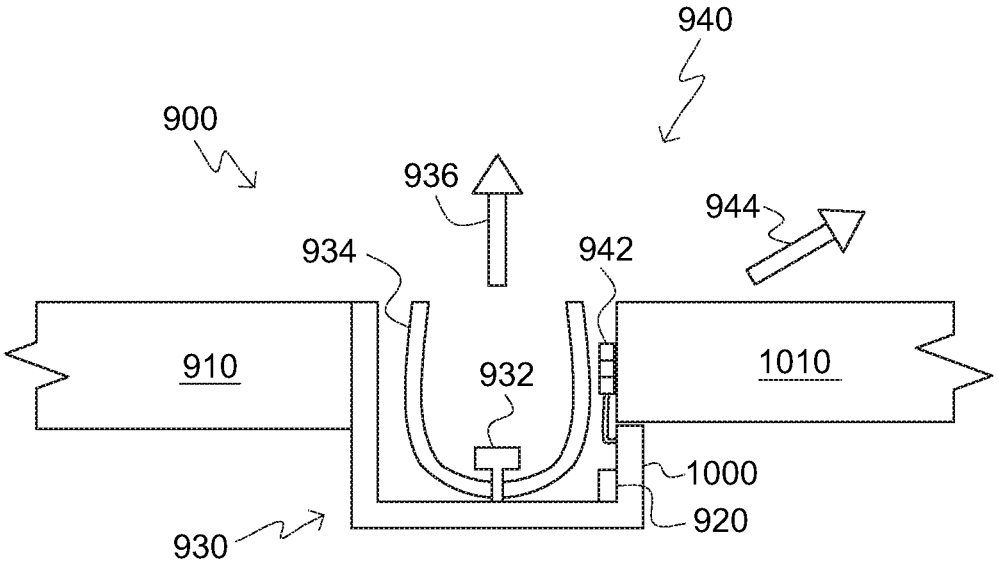
FIG. 10 is a side cross-sectional view of a lighting module, according to one embodiment of the invention.

Looking to FIGS. 9 and 10, in regards to a lighting module 900 of a set of operational modules of a road marker, wherein FIG. 9 is module diagram of a lighting module and FIG. 10 is a side cross-sectional view of a lighting module, there is shown a dual beam lighting system including a upwardly directed beam 936 configured to penetrate accumulated snow and a diagonally directed beam 944 configured to be visible to drivers during non-snow conditions.

The illustrated module 900 includes a power module 910 functionally coupled to each of an upward beam module 930 and a diagonal beam module 940 which are controlled by a control module 920. The illustrated upward beam module 930 includes a light device 932 disposed within a curved mirror 934 which channels and directs light from the light device 932 upwardly. The diagonal beam module 940 includes a light device 942 with a plurality of light emitters of various colors and/or brightness that is adjacent to a light channel 944 which may be a diffuser. There is also shown a lighting housing body 1000 which contains and/or couples various components described herein.

The illustrated power module 910 may include one or more solar cells for converting solar radiation into electrical power. It may also include one or more batteries (may be rechargeable) and/or capacitors for storing electrical energy therein for use by the module. The power module is functionally coupled to the other modules of the lighting module 900 as needed for their operation and/or to other modules, such as but not limited to a sensor module and/or a communication module.

The illustrated control module 920 includes one or more processors that may be functionally coupled to a bus and/or memory device that allow for the control module to direct activity of one or more other modules described herein. Such a control module may include one or more scripts/programs under which it operates and/or directs operation of other modules. The control module may be functionally coupled to transistors and/or logical circuitry, thereby managing, operating, activating, deactivating, and otherwise controlling other modules.

The illustrated upward beam module 930 includes a light emitter that directs a strong beam of light in an upward direction relative to the top surface of the road marker. During normal operation in good weather, such a light would generally not be visible to drivers, since their view of such markers will be at a diagonal angle thereto. However, when the road is covered in a translucent material, such as but not limited to a layer of snow, the strong upward directed light will diffuse thereby and then be visible to drivers of vehicles. Advantageously, this allows for drivers to be able to tell where the road is, since the road markers are thereby detectable by the drivers and the array of such markers indicates the path of the road. Generally, in areas with lots of snowfall, flags are erected along the sides of the road to show the boundary of the road, but such are only as good as the flags are tall and they don't actually show the path of the road itself, just the boundary of being off the road. The upward beam module provides more detailed information about the road and is not limited to a particular height of snow. There may be a plurality of light emitters of varying colors. There may be a deflector/diffusor disposed above the light emitter(s) that may deflect/diffuse a portion of the light there emitted to be visible by drivers, e.g. during the daytime and the light emitters may be strong enough to be visible during the day.

The illustrated diagonal beam module 940 produces light at an angle that is visible to drivers as they are driving down a road. The illustrated diagonal beam module includes a plurality of light emitters of varying colors so that different information can be displayed and such emitters (e.g. LED light emitters) may be controlled by a control module in order to provide varying information (e.g. blinking red light may serve as a warning of traffic problems ahead). The diagonal beam module includes a layer of material 1010 adjacent to the light emitters 942 which acts to direct (e.g. by diffraction/deflection) and/or diffuse the light therefrom such that light from the emitters is directed at an angle and in an amount sufficient for drivers to see the same. It may be that one or of the light emitters are facing horizontally and that the layer of material may deflect such light upward so that it is diagonally directed.

Figure 11:
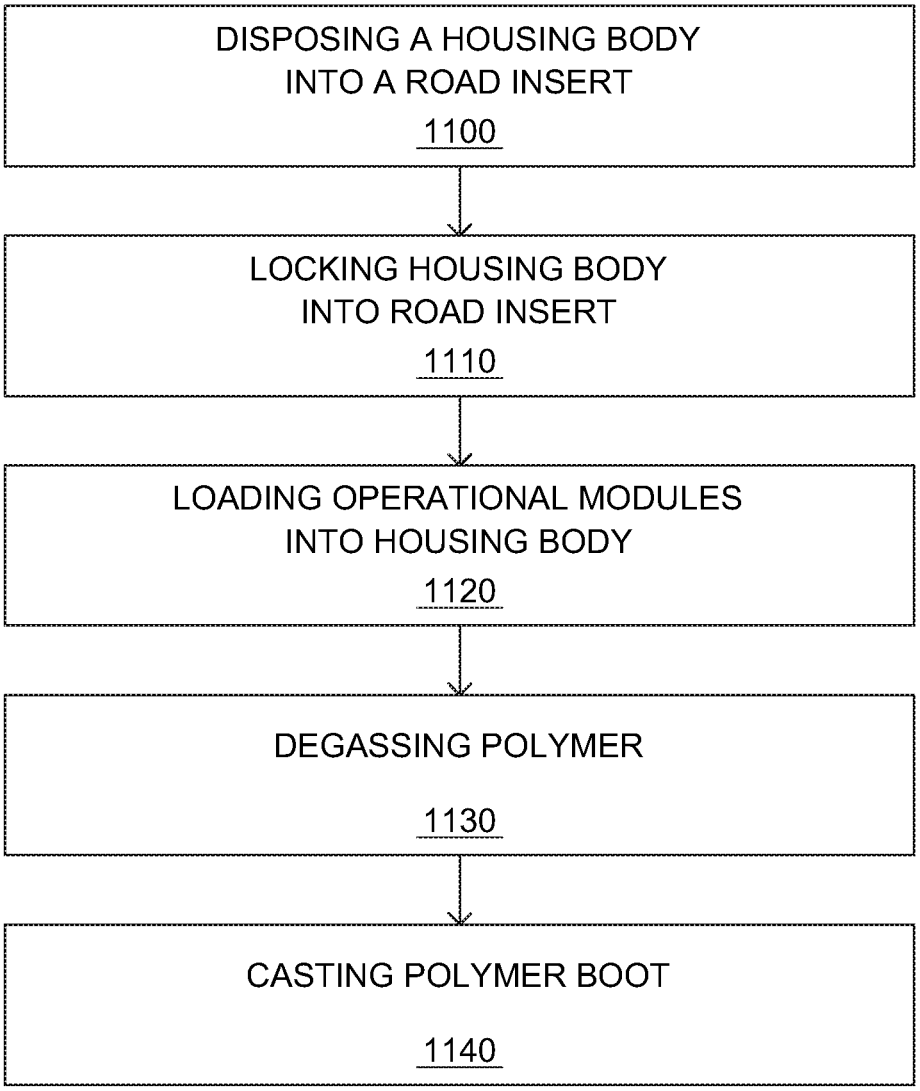
FIG. 11 is a flow chart showing a method of manufacturing a road marker, according to one embodiment of the invention.

FIG. 11 is a flow chart showing a method of manufacturing a road marker, according to one embodiment of the invention. There are shown steps of: disposing a housing body into a road insert 1100; locking a housing body into a road insert 1110; loading operational modules into housing body 1120, degassing a polymer quantity 1130; and casting a polymer boot 1140. Advantageously, such a method provides for superior road markers that may be installed in existing roads for the safety and benefit of the driving public.

The illustrated step of disposing a housing body into a road insert 1100 may include disposing a housing body having a housing cavity into an internal cavity of a road insert and/or into a tapered front cavity of the road insert with a plurality of spacers therebetween the housing body and the road insert. It may be that the spacer(s) are coupled to the housing body and/or the insert, such as but not limited to by an adhesive. The housing body is thereby separated from the insert body by a small amount, leaving a gap therebetween where a boot may be cast. The exterior surface of the housing body substantially mates with an interior surface of the insert such that the housing body may be fully inserted thereinside. Such placement may be done manually and/or by operation of one or more machines/robots.

It may be that the housing body includes a channel disposed along a backside and/or an underside thereof, through which compressed air may be injected to facilitate removal of the housing body from the boot. The channel may be covered by a length of tape or other barrier to prevent boot material from entering the channel during casting of the boot. The channel need only be deep enough to permit airflow therethrough by application of compressed air when/if it is desired to remove the housing from the boot, such as but not limited to the case where the housing is to be replaced.

It may be that the housing body includes exterior textures that cooperate with interior textures of the road insert to form a taper lock therebetween when the boot is cast therebetween. Such structures may include an array of angled protrusions that are angled such that forward motion of the housing body relative to the insert, when the boot is disposed therebetween, causes the connection between the housing body, boot, and/or insert to tighten. It is understood that the variations of such structures are plethoric, and that one of ordinary skill in the art would be able to develop a variety of such cooperating taper lock structures given instructions to do so.

The illustrated step of locking a housing body into a road insert 1110 may include locking a rear lock behind the housing body and to the road insert such that the housing body is prevented from rearward displacement. The rear lock may include a plurality of locks and/or other securing structures. As used herein, a lock is a device which secures and restricts a particular movement of an associated structure. It is not necessary that such locks be openable only by "keys" or other limited access tools, however such may be utilized therewith.

Generally a lock will be secured by one or more fasteners (e.g. screw, bolt, nail, pin, rivet) that may use a non-standard tool (e.g. not a flat-head or Philips screwdriver, not a standard bolt-head shape/size) for removing the same so that the general public is not able to remove the same easily. It may be that a cam lock is used in cooperation with a wedge lock to secure the housing body to the insert. It may be that the lock(s) are secured in place before the boot is cast and therefore the housing body is not actually "locked" in place until the boot is cast, but securing the locking mechanism(s) and/or device(s) such that they will lock the housing in place after the boot is cast is sufficient for this step if such occurs.

The illustrated step of loading operational modules into housing body 1120 may include disposing one or more operational modules within the housing cavity. Such may be secured with one or more adhesives, fasteners, clips, ties, friction fittings and the like to one or more coupling structures (e.g. holes, posts, eyelets) that may be inside the housing body. Such operational modules may include one or more of: control modules, lighting modules, power modules, sensor modules, power storage modules, communications modules and the like and combinations thereof. Such modules may be functionally coupled to each other in order to fulfil their desired operational parameters.

The illustrated step of degassing a polymer quantity 1130 may include degassing the polymer before the casting step. Wherein a polymer is degassed before/during casting, its compressibility is reduced and may be reduced essentially to zero so that the resultant cast polymer is essentially incompressible under operating conditions. Degassing may be effected by use of a vacuum desiccator or centrifuge on molten polymer material. U.S. Pat. No. 4,372,758 provides a method of degassing olefin polymers and is incorporated by reference herein for its supporting teachings.

The following is a non-limiting exemplary method of degassing a PDMS mixture without a vacuum desiccator or a laboratory centrifuge:

1. Weigh the PDMS base and curing agent in the desired ratio in a disposable cup. 10:1 is the most common ratio, but any ratio can be used depending on the desired stiffness of the cured polymer.

2. Mix base and curing agent together with the stirrer attachment of the hand-held electric mixer. Pour the pre-polymer evenly into 2 or 4 centrifuge tubes. If there is not enough pre-polymer for 2 or 4 tubes, fill 1 or 3 tubes and one more tube with water for balancing. It is important to balance the attachment during spinning. Tightly seal the centrifuge tube caps.

3. Tie the tubes to the stirrer attachments of the handheld mixer. Hold the mixer in a vertical position, switch on and spin for 2.5 minutes, then stop to give the spinner a rest for 1 minute. Turn the bottles 180 degrees and spin for another 2.5 minutes until all the bubbles have escaped from the pre-polymer mixture.

4. Pour the centrifuged PDMS onto the patterned reverse master mold in the baking cup or Pyrex petri dish.

5. Put the master mold container in the oven and cure at 80° C. for 10 minutes if the baking cup is used. If the Pyrex petri dishes are used, the heat must be switched on for 5 minutes then off for 5 minutes since Pyrex dishes can crack under continuous heat. Switch the heat on and off for 30 minutes.

6. Peel the PDMS slab off the master using a sharp-tipped knife and store the PDMS chip in a polystyrene dish before autoclaving or treating with oxygen plasma.

The illustrated step of casting a polymer boot 1140 may include casting a polymer boot into the space between the housing body and the road insert such that the boot is form-fit to each of the housing body and the road insert and couples a bottom exterior of the housing body to the internal cavity of the road insert. Generally, molten polymer material is injected or otherwise forced into the space between the housing body and the insert created by one or more spacers therebetween and then allowed to cool/cure into a hardened polymer. Such may be done under vacuum conditions.

Figure 12:
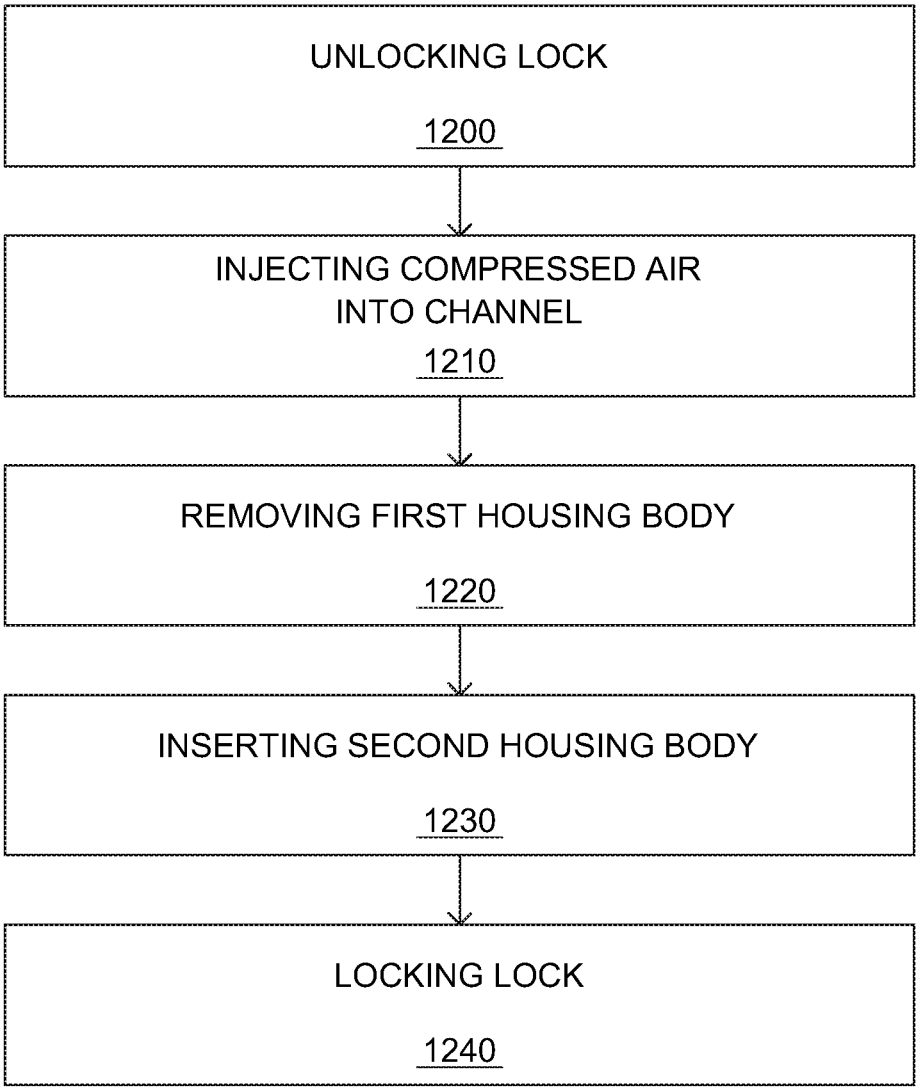
FIG. 12 is a flow chart showing a method of replacing a housing body of a road marker, according to one embodiment of the invention.

FIG. 12 is a flow chart showing a method of replacing a housing body of a road marker, according to one embodiment of the invention. There are shown steps of: unlocking a lock 1200; injecting compressed air into a channel 1210; removing a first housing body 1220; inserting a second housing body 1230; and locking a lock 1240. Any road marker described herein, explicitly or implicitly, may be utilized herein so long as it includes the structure(s) described in the method.

The illustrated step of unlocking a lock may include unlocking a rear lock disposed behind the housing body. It may be that the rear lock is a cam lock locked by a wedge lock. Such may be accomplished by removing one or more fasteners which couple the lock(s) in place. Generally, wherein the fasteners are coupled using non-standard tools, similar such tools will be used to remove the same.

The illustrated step of injecting compressed air into a channel may include injecting compressed air into a channel disposed along an underside of the housing body and thereby separating the housing body from a form-fit boot that is form-fit coupled to a road insert. Such may be accomplished by inserting a nozzle of a compressed air source (e.g. canister, tube coupled to a compressed air generator) adjacent to and/or into such a channel near an opening thereto and then allowing the compressed air to flow into the channel. As the air enters the channel it creates a high pressure condition within the channel, which then forces the housing body to lift away from the boot.

The illustrated step of removing a first housing body may include removing the housing body from a boot that is disposed within a road insert. Such may be accomplished by simply lifting the first housing body from the boot.

The illustrated step of inserting a second housing body may include placing a second housing body into the boot. Such may be accomplished by sliding the second housing body into the boot, wherein the second housing body has a substantially identical exterior surface geometry so that it mates with the boot.

The illustrated step of locking a lock may include locking the rear lock behind the second housing body. Such may be accomplished by using tools to secure the fasteners thereof.

It may be that the road insert has an exterior texture that includes upwardly facing ridges and an internal cavity including interior surface textures and a tapered front cavity and the housing body includes a tapered front shaped to mate with the tapered front cavity of the road insert and thereby be trapped therein and an array of exterior surface textures that operate together with the interior surface textures of the road insert through the boot to operate as a forward operating taper lock between the housing body and the road insert that restricts forward movement and rotation of the housing body with respect to the road insert. It may be that the boot consists essentially of a degassed polymer.

Figure 13:
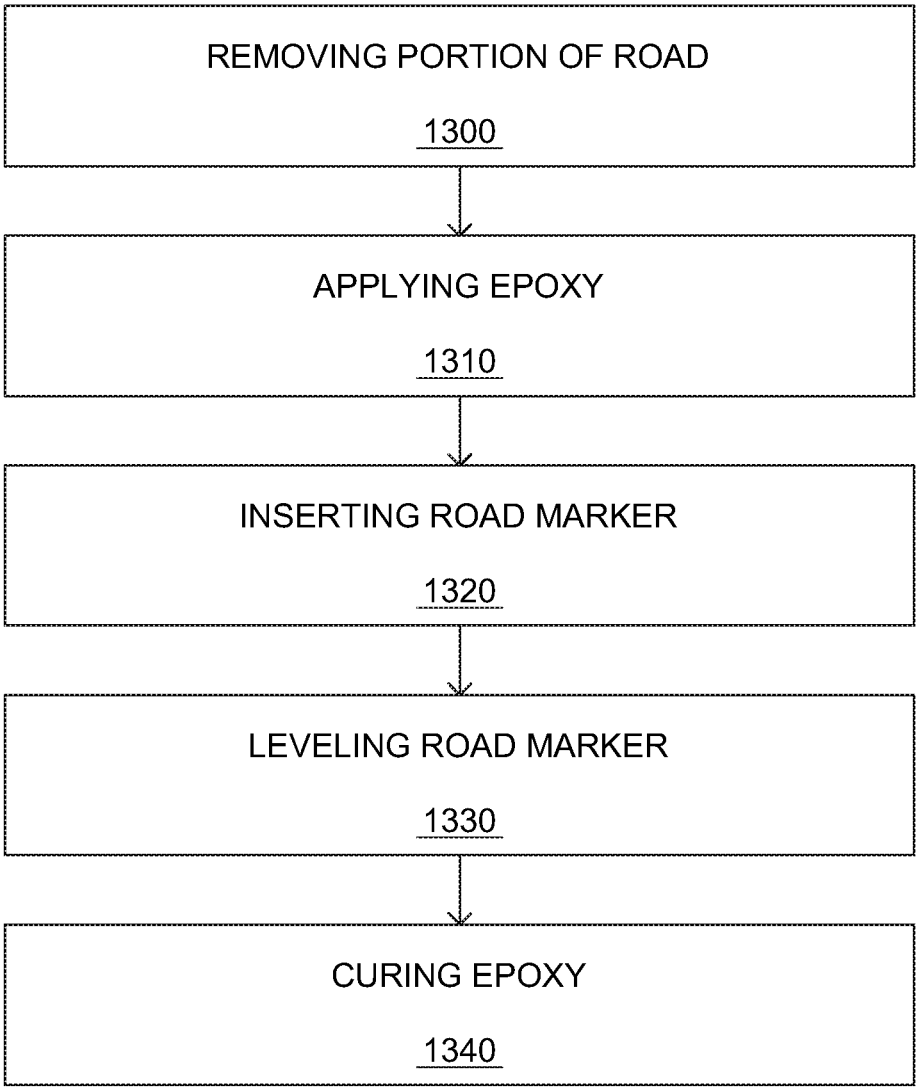
FIG. 13 is a flow chart showing a method of installing a road marker into a road, according to one embodiment of the invention.

FIG. 13 is a flow chart showing a method of installing a road marker into a road, according to one embodiment of the invention. There are shown steps of: removing a portion of the road 1300; applying epoxy 1310; inserting a road marker 1320; leveling a road marker 1330; and curing the epoxy 1340.

The illustrated step of removing a portion of the road may include removing a portion of the road, thereby forming a cavity in the road. It may be that the step of removing is accomplished by an array of circular saws, jack-hammer, a gouger, scraper, cutter, or other device for removing road material.

The illustrated step of applying epoxy may include applying a quantity of epoxy into the cavity. Such may be accomplished by applying quantities of epoxy to an interior of the cavity in amounts and of a type having operational characteristics and parameters (e.g. strength, durability, elasticity, curing time, curing method, ability to secure to asphalt/concrete/metals) that match with the intended use.

The illustrated step of inserting a road marker may include inserting a road marker into the cavity, the road marker including an exterior texture that includes upwardly facing ridges and an internal cavity including interior surface textures and a tapered front cavity into which a boot and housing body are disposed and locked, the housing body including a lighting system to provides illumination through a top surface thereof. It may be that the housing body is selectably removable from the boot. The road marker may be any road marker described, explicitly or implicitly, herein so long as it includes the structure(s) described in the method.

The illustrated step of leveling a road marker may include leveling the road marker to be flush with the road surface. Such may be accomplished by tamping the road marker, cutting the road marker, grinding the road marker, removing the road marker and cutting additional road material, adding/removing epoxy/asphalt/concrete, and the like and combinations thereof.

The illustrated step of curing the epoxy may include curing the epoxy, thereby securing the road marker to the road. Such may be accomplished according to the particular curing techniques required for the epoxy used, including but not limited to the passage of time, exposure to temperatures/chemicals/radiation, and the like and combinations thereof.

Figure 14:
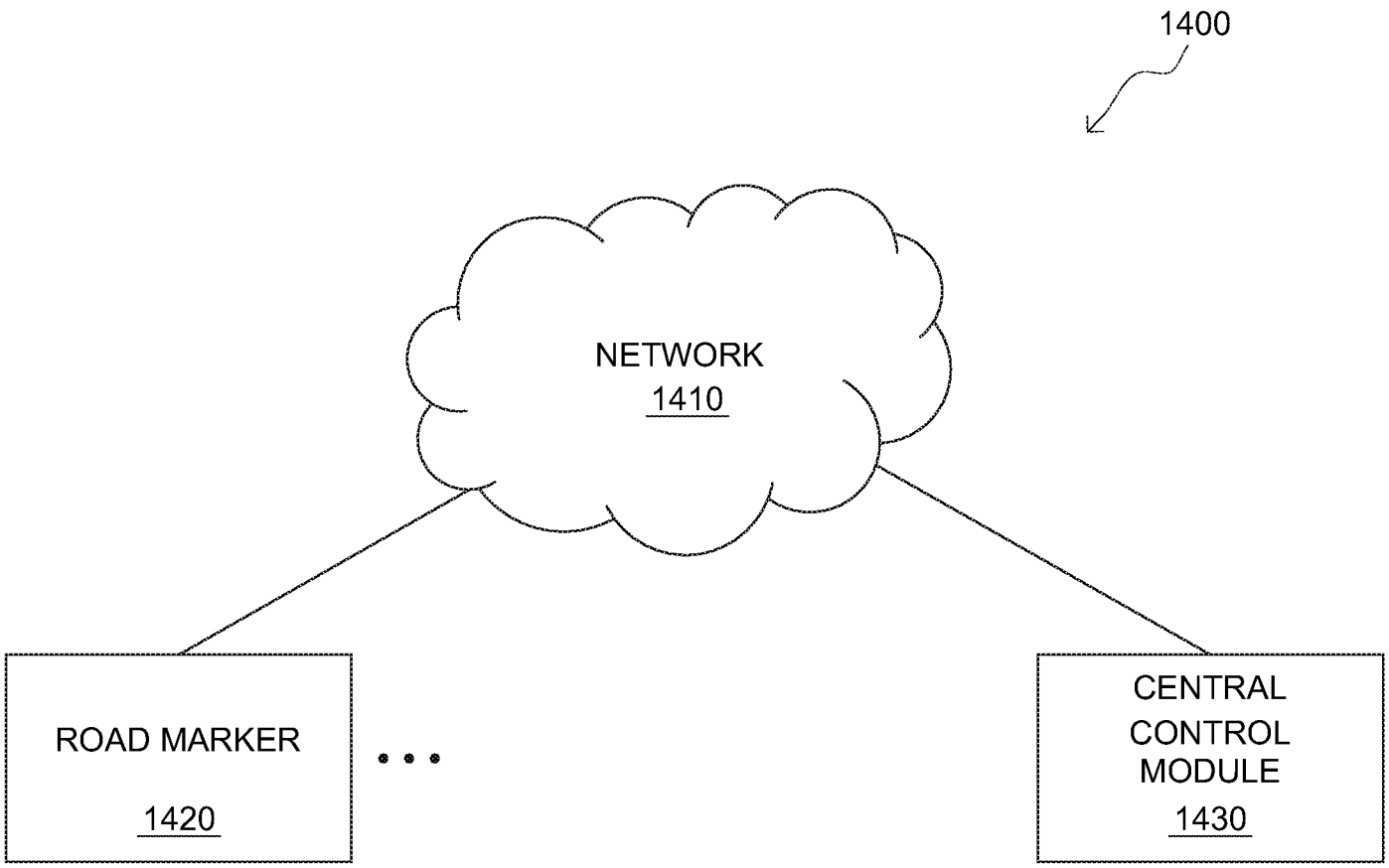
FIG. 14 is network diagram showing a system of road markers, according to one embodiment of the invention.

FIG. 14 is network diagram showing a system of road markers 1400, according to one embodiment of the invention. There is shown a system of road markers including a plurality of networked road markers 1420 that may have one or more sensors disposed within a system of roads. Each of the illustrated road markers is coupled to central control module 1430 through a network 1410 running as an application on a computing device.

The illustrated network 1410 may include one or more mesh networks, cellular phone networks, wifi networks, Bluetooth networks, radio communications networks, microwave communications networks and the like and combinations thereof. Such may include one or more internet/intranet networks such as but not limited to private/government networks that control critical infrastructure.

The illustrated road markers 1420 may include one or more variations described explicitly or implicitly herein.

The illustrated central control module 1430 may include instructions for controlling, communicating with, networking, categorizing, grouping, and/or activating/deactivating one or more road markers functionally coupled thereto and/or collecting data from the same. It may be that the central control module includes identification and location information for one or more road markers and/or displays on a GUI one or more interfaces that allow such an operator to view and manage a plurality of such markers. Such a system may include functional data connections to other systems of traffic management, such as but not limited to traffic cam systems, police and emergency services systems, satellite imaging systems, and the like and combinations thereof. Such data may be collected, collated, organized, mined, and utilized to manage/control traffic on roads via instructions sent to road markers and/or groups of road markers in combination with driver educations programs and/or systems such as but not limited to linked real-time video billboards and the like.

In one non-limiting embodiment, there is a plurality of networked in-road lighting devices (e.g. using a mesh network, such as but not limited to the DUST modules produced by Linear Technologies of 1630 McCarthy Blvd., Milpitas Calif., 95035) coupled to a larger network which allows for central control from a traffic management operations system running as an application on a computing device and that collects data from the devices and from other systems so that that information can be used to manage traffic, issue alerts, acquire usage and performance data and/or provide real-time management.

It is understood that the above-described embodiments are only illustrative of the application of the principles of the present invention. The present invention may be embodied in other specific forms without departing from its spirit or essential characteristics. The described embodiment is to be considered in all respects only as illustrative and not restrictive. The scope of the invention is, therefore, indicated by the appended claims rather than by the foregoing description. All changes which come within the meaning and range of equivalency of the claims are to be embraced within their scope.

Finally, it is envisioned that the components of the device may be constructed of a variety of materials, including but not limited to metals, ceramics, plastics, fibers, natural materials, polymers/plastics/rubbers, and the like and combinations/composites thereof.

Thus, while the present invention has been fully described above with particularity and detail in connection with what is presently deemed to be the most practical and preferred embodiment of the invention, it will be apparent to those of ordinary skill in the art that numerous modifications, including, but not limited to, variations in size, materials, shape, form, function and manner of operation, assembly and use may be made, without departing from the principles and concepts of the invention as set forth in the claims. Further, it is contemplated that an embodiment may be limited to consist of or to consist essentially of one or more of the features, functions, structures, methods described herein.

What is claimed is:

1. A road marker housing, comprising:

a. a road insert having an exterior texture that includes upwardly facing ridges and an internal cavity including interior surface textures and a tapered front cavity;

b. a boot of incompressible material disposed within the internal cavity of the road insert and form-fit thereto, the boot having a boot cavity; and c. a housing body removably disposed within the boot cavity and form-fit thereto, the housing body including:

i. a tapered front shaped to mate with the tapered front cavity of the road insert and thereby be trapped therein;

ii. an array of exterior surface textures that operate together with the interior surface textures of the road insert through the boot to operate as a forward operating taper lock between the housing body and the road insert that restricts forward movement and rotation of the housing body with respect to the road insert; and iii. a housing cavity within which one or more physical modules may be disposed; and d. a rear lock removably disposed inside the road insert behind the housing body that prevents rearward displacement of the housing body with respect to the road insert.

2. The housing of claim 1, wherein the rear lock is a cam lock.

3. The housing of claim 1, further comprising a wedge lock disposed over the rear lock and locking the rear lock into place.

4. The housing of claim 1, wherein the housing body includes a channel disposed along an underside thereof, through which compressed air may be injected to facilitate removal of the housing body from the boot.

5. The housing of claim 1, wherein the upwardly facing ridges are tooth-shaped.

6. The housing of claim 1, wherein the road insert is rectangular from a top plan view.

* * * * *